United States Patent [19]

Dalmaso

[11] 4,253,544

[45] Mar. 3, 1981

[54] ENERGY ABSORBING LANYARD

[75] Inventor: George C. Dalmaso, Polk, Pa.

[73] Assignee: Inco Safety Products Company, Franklin, Pa.

[21] Appl. No.: 120,207

[22] Filed: Feb. 11, 1980

[51] Int. Cl.[3] ..... A62B 35/00

[52] U.S. Cl. ..... 182/3; 182/18

[58] Field of Search ..... 182/3, 5, 6, 7, 18

[56] References Cited

U.S. PATENT DOCUMENTS

| | | | |
|---|---|---|---|
| 2,303,954 | 12/1942 | Roke | 182/3 |
| 3,444,957 | 5/1969 | Ervin | 182/3 |
| 3,804,698 | 4/1974 | Kinloch | 182/3 |

FOREIGN PATENT DOCUMENTS

| | | | |
|---|---|---|---|
| 2402383 | 4/1979 | France | 182/3 |

*Primary Examiner*—Reinaldo P. Machado

*Attorney, Agent, or Firm*—R. J. Kenny; E. A. Steen

[57] ABSTRACT

A shock absorbing lanyard (10) having a warning flag (20) for indicating the status of the lanyard (10). Upon the application of a predetermined force, as the lanyard (10) elongates, a gathered section (18) simultaneously stretches and frees the flag (20). The freed flag (20) indicates that the lanyard (10) has been used and must be discarded.

11 Claims, 5 Drawing Figures

ENERGY ABSORBING LANYARD

TECHNICAL FIELD

This invention relates to safety belts, safety harnesses and the like in general and more specifically to an energy or shock absorbing lanyard affixed to such devices.

BACKGROUND ART

Workers, exposed to the danger of falling, often wear safety harnesses or belts. Typically, these safety devices are attached to a lifeline or lanyard. The lanyard, in turn, is securely affixed to a convenient anchorage point. Should the worker fall, his descent is quickly checked by the lanyard. Unfortunately, when the line has a great deal of slack (to accommodate worker movement), the worker may fall a considerable distance before the lanyard breaks his fall. Inasmuch as a falling body accelerates at a constant rate of 32 feet-sec$^{-2}$ (9.8 meters-sec$^{-2}$), the rapid deceleration of the falling worker caused by the sudden tautness in the lanyard may result in serious bodily injury. Indeed, it has been suggested that when a belt restraint system is utilized, the maximum force to be tolerated by a human being should not exceed 10 G forces. It should be appreciated, however, a falling person jerked to a stop by a suddenly rigid lanyard may experience forces considerably greater than 10 G's.

Accordingly, various shock absorbing or shock reducing systems for lanyards have been developed to absorb a substantial portion of the kinetic energy generated during a fall. In this manner, the worker is decelerated gradually rather than being brought to an abrupt halt. For example, systems employing elastic fibers, tear-away elements and piston-cylinder shock absorbers have been used to cushion the shock of a fall.

Under existing and proposed standards, lanyards which have been subjected to either impact loading by a falling worker or loading exceeding a predetermined value must be removed from service and replaced immediately. However, when a semi-drawn or bulked continuous filament fiber shock absorbing lanyard is employed, oftentimes it is difficult to determine whether the aforementioned conditions have indeed occurred. After one incident, such lanyards have outlived their usefulness. Clearly, a means of alerting an unsuspecting worker of the existing conditions of the lanyard is desirable and, in fact, necessary.

SUMMARY OF THE INVENTION

Accordingly, there is provided means for indicating the present physical condition of a lanyard. A jacket circumscribes a core of semi-drawn synthetic or bulked continuous filament material. A portion of the jacket is gathered "accordion style" along a section of the core. An indicator flag is affixed to the gathered area of the jacket with breakaway stitching. When a suitable load is impressed upon the lanyard, the stretching action of the gathered section of the jacket causes the stitching to break thereby releasing the flag.

PREFERRED MODE FOR CARRYING OUT THE INVENTION

Figure 3:
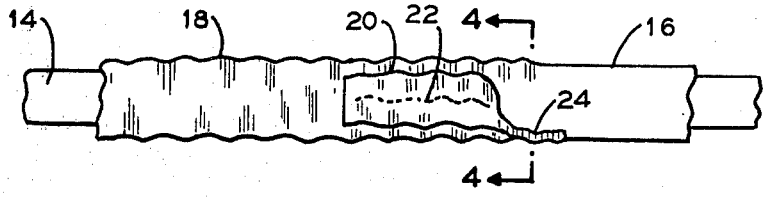
FIG. 3 is a top plan view of the invention.
Figure 2:
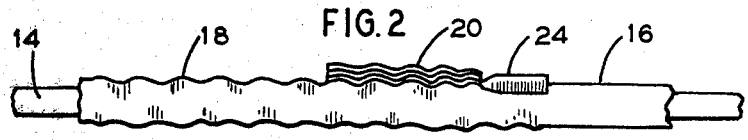
FIG. 2 is a detailed side view of the invention.
Figure 1:
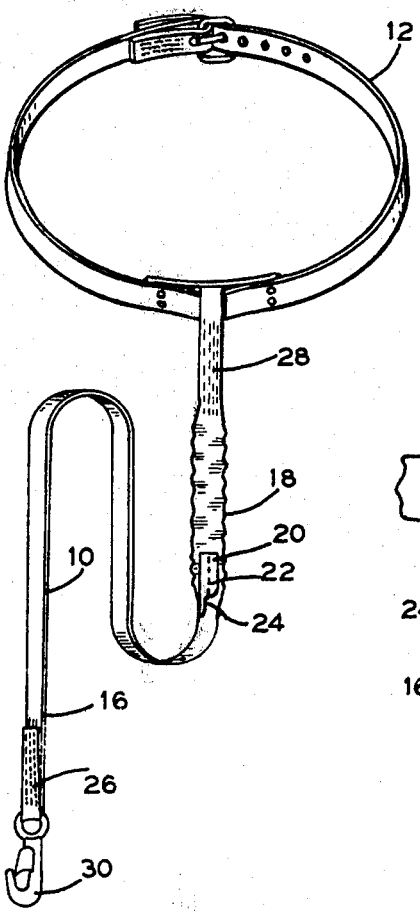
FIG. 1 is a general view of an embodiment of the invention.

Referring to FIG. 1, there is shown a lanyard 10 attached to a safety belt 12. Typically, the belt 12 is worn about the waist of a worker whereas the free end of the lanyard 10 is affixed to a secure location.

The lanyard 10 includes a tensile load bearing core 14 circumscribed by a jacket 16. The core 14 is made from a synthetic semi-drawn high tenacity or bulked continuous filament material, preferably nylon, having a predetermined tensile yield strength. The jacket 16 may also be comprised of nylon. Due to the nature of the design of the lanyard 10, the jacket 16 is longer than the core 14 by a predetermined length. The excess material may be bunched or gathered accordion-style along a section 18 of the lanyard 10. It has been determined that an approximate ratio of three inches (7.62 centimeters) of slack to one foot (30.48 centimeters) of jacket is satisfactory. Therefore, for a typical six foot (1.82 meter) lanyard, eighteen inches (45.72 centimeters) of gathered section 18 is desirable. Of course, this ratio may be altered depending on the materials utilized and the contemplated service conditions. Hook 30 serves to attach the free end of the lanyard 10 to an anchor (not shown). The opposite end of the lanyard 10 is shown permanently affixed to the belt 12. It should be appreciated, however, that the lanyard 10 may be affixed to the belt 12 (or any other safety device) by other known means as well. In any event, reinforced, doubled over sewn sections 26 and 28 serve to retain and reinforce any attachment means selected.

A large portion of indicator flag 20 is folded upon itself and temporarily affixed to the gathered section 18 and the core 14 by breakaway stitching 22. A simple single basting stitch holds the flag 20 to the section 18 in a secure but temporary manner. The basting stitch should be applied so that when a sufficient tensile force is applied to the lanyard 10, the stitches 22 will rip and break away, thereby freeing the flag 20. Bar tack 24 permanently affixes the remainder of the flag 20 to the jacket 16. The jacket 16, in turn, is sewably attached to the core 14.

The invention and manner of applying it may, perhaps, be better understood by a brief discussion of the principles underlying the invention.

A shock absorbing lanyard of the type claimed herein is designed to absorb and dissipate the shock forces generated by a rapidly decelerating object; in this case, a falling body attached to a suddenly taut lifeline. To substantially reduce the potentially injurious shock, the core 14 begins to stretch at a controlled rate in order to decelerate the worker. Instead of jerking the hapless worker to an abrupt, gut wrenching stop, the lanyard 10 reduces the shock transmitted to him so that the chances of injury are considerably reduced. Generally, such lanyards are designed to start operating above a predetermined value, usually 600 pounds-inch$^{-1}$ ($4.14\times10^6$ newtons-centimeter$^{-1}$). Accordingly, the core material will have a corresponding predetermined threshold tensile yield strength above which the core will begin to elongate. In this manner, the usual small stretches, tugs and pulls generated by the worker during typical working conditions will not serve to elongate the lanyard.

Briefly, the core material is made from a synthetic semi-drawn high tensile load bearing or bulked continuous filament material (usually nylon). Upon the application of a tensile force above the preselected value, the fibers tend to elongate or draw along a plane substantially parallel with the longitudinal axis of the lanyard. Since a relatively large amount of energy is necessary to draw the fibers, a significant percentage of the kinetic energy generated by a falling body will be absorbed by the core during the fiber stretching process. This stretching action tends to break the fall of the worker since much of the resultant energy is absorbed by the lanyard rather than by the falling worker.

From the foregoing discussion, it should be acknowledged that once this type of lanyard has served its purpose, its usefulness has been exhausted. The drawn or bulked continuous filament fibers contained therein no longer exhibit the requisite elastic properties necessary to cushion the debilitating effects of an abrupt deceleration. However, as opposed to other types of shock absorbers, there is no satisfactory way of determining the condition of the lanyard at a quick glance. An exhausted lanyard is useless and in fact quite dangerous. Accordingly, the instant invention displays an indicator flag 20 when the lanyard is stressed beyond the predetermined value.

Figure 5:
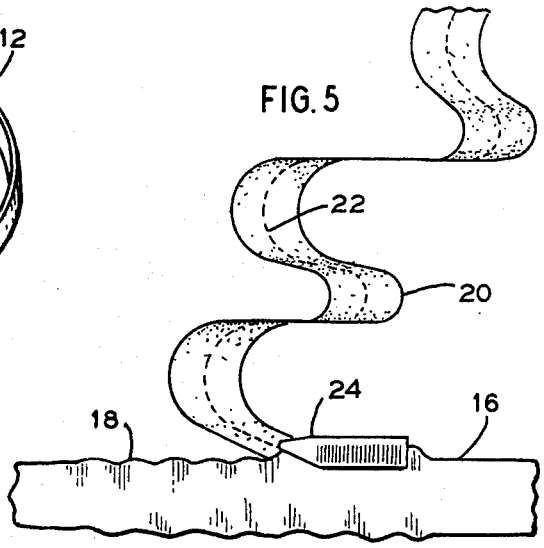
FIG. 5 is a detailed side view of the invention.
Figure 4:
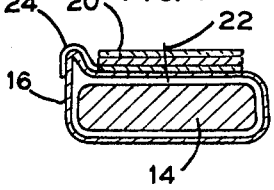
FIG. 4 is a cross-sectional view taken along line 4—4 of FIG. 3.

The flag 20 release action is initiated as the gathered section 13 begins to stretch as a result of the elongation of the lanyard 10. As the elongation becomes more pronounced, the forces generated will cause the gathered section 18 to stretch which, in turn, will cause the break-away stitching 22 to rip, thus freeing the folded portion of the flag 20. See FIG. 5. The flag 20 may be imprinted with suitable warnings such as "DO NOT USE", "REPLACE" and the like. In this fashion, anyone handling the lanyard 10 can determine, quickly and easily, the status of the lanyard 10.

While in accordance with the provisions of the statutes, there is illustrated and described herein specific embodiments of the invention, those skilled in the art will understand that changes may be made in the form of the invention covered by the claims and that certain features of the invention may sometimes be used to advantage without a corresponding use of the other features.

The embodiments of the invention in which an exclusive property or privilege is claimed are defined as follows:

1. An energy absorbing lanyard, the lanyard comprising a tensile load bearing core having a predetermined tensile yield strength, a tube jacket affixed to and circumscribing the core, an indicator flag affixed to the jacket, and means for freeing at least a portion of the flag from the jacket when the lanyard is subjected to a tensile load above a predetermined value.

2. The lanyard according to claim 1 wherein a portion of the jacket is gathered about the core to accommodate extension of the core when the load is impressed upon the lanyard.

3. The lanyard according to claim 2 wherein the jacket is longer than the core in the approximate ratio of three inches of gathered jacket material for each foot of lanyard.

4. The lanyard according to claim 2 wherein the freeable portion of the flag is folded upon itself, the folds temporarily affixed to the gathered portion of the jacket and ready to be released when the load is impressed upon the lanyard.

5. The lanyard according to claim 4 wherein the flag is affixed to the jacket with breakaway stitching.

6. The lanyard according to claim 1 wherein one end of the flag is permanently affixed to the jacket.

7. The lanyard according to claim 1 wherein the core is made from a synthetic semi-drawn material.

8. The lanyard according to claim 1 wherein the core is made from a synthetic bulked continuous filament material.

9. The lanyard according to claim 1 wherein the jacket is made from a synthetic material.

10. The lanyard according to claims 7, 8 or 9 wherein the synthetic material is nylon.

11. The lanyard according to claim 1 wherein at least one end of the lanyard includes means for attaching the lanyard to another object.

* * * * *